33-257 SR
8/27/85 OR 4,536,966

United States Patent [19]

Engel

[11] Patent Number: 4,536,966

[45] Date of Patent: Aug. 27, 1985

[54] REAR-SIGHT FOR A WEAPON

[75] Inventor: Isaac Engel, Tel-Aviv, Israel

[73] Assignee: The State of Israel, Ministry of Defence, Military Industries, Israel

[21] Appl. No.: 625,653

[22] Filed: Jun. 28, 1984

[30] Foreign Application Priority Data

Aug. 18, 1983 [IL] Israel ..... 69516

[51] Int. Cl.[3] ..... F41G 1/28

[52] U.S. Cl. ..... 33/257

[58] Field of Search ..... 33/233, 252, 257, 258, 33/259

[56] References Cited

U.S. PATENT DOCUMENTS 1,150,791 8/1915 Swebilius et al. ..... 33/257
3,792,534 2/1974 Lowe ..... 33/257

FOREIGN PATENT DOCUMENTS 141708 5/1980 Fed. Rep. of Germany ..... 33/233

*Primary Examiner*—Harry N. Haroian
*Attorney, Agent, or Firm*—Steinberg & Raskin

[57] ABSTRACT

A rear sight for a gun comprises a bolt shaped element with a radial slot of preselected depth and width. By the threading of the threaded end of the bolt shaped element in and/or out of a threaded sight ear of the gun, the recess is alignable crosswise.

6 Claims, 7 Drawing Figures

REAR-SIGHT FOR A WEAPON

BACKGROUND OF THE INVENTION

The present invention generally relates to a weapon sighting assembly and, more particularly, to a rear sight for a weapon, such as a rifle, pistol, machine gun and the like.

A typical sighting assembly for such a weapon, generally referred to as a gun, consists of a front sight and a rear sight. The front sight is typically blade-like, often in the shape of a small diameter cylinder which is sometimes tapered so that its top is of minimal diameter. The height of the top is adjustable for ranging purposes. The rear sight is typically in the shape of a block with a V-shaped or U-shaped groove. The gun user uses these sights by aligning the top of the front sight with the top of the groove and centered therein. The rear sight is slidable to the right or left for course alignment.

In the prior art an advanced type slidable rear sight consists of a substantial number of parts which need be machined precisely, thus increasing its cost.

SUMMARY OF THE INVENTION

The present invention is directed to a new improved rear sight which consists of a minimum number of easily machinable parts. The present invention may be described as, a rear sight for use with a front sight on a gun comprising:

a bolt shaped element including a head and a body having first and second portions extending from said head to an opposite end of said element, said first portion being cylindrically shaped of a diameter definable as D1, extending a preselected distance from said head toward said element end and said second portion being cylindrically shaped of a diameter D2 and extending from said first portion to said element end with peripheral threads, D2 being not greater than D1, said first portion defining a radial slot of a width W and depth R where $R<(D1)/2$.

BRIEF DESCRIPTION OF THE DRAWINGS

The invention will best be understood from the following description when read in conjunction with the accompanying drawings.

Figure 1:
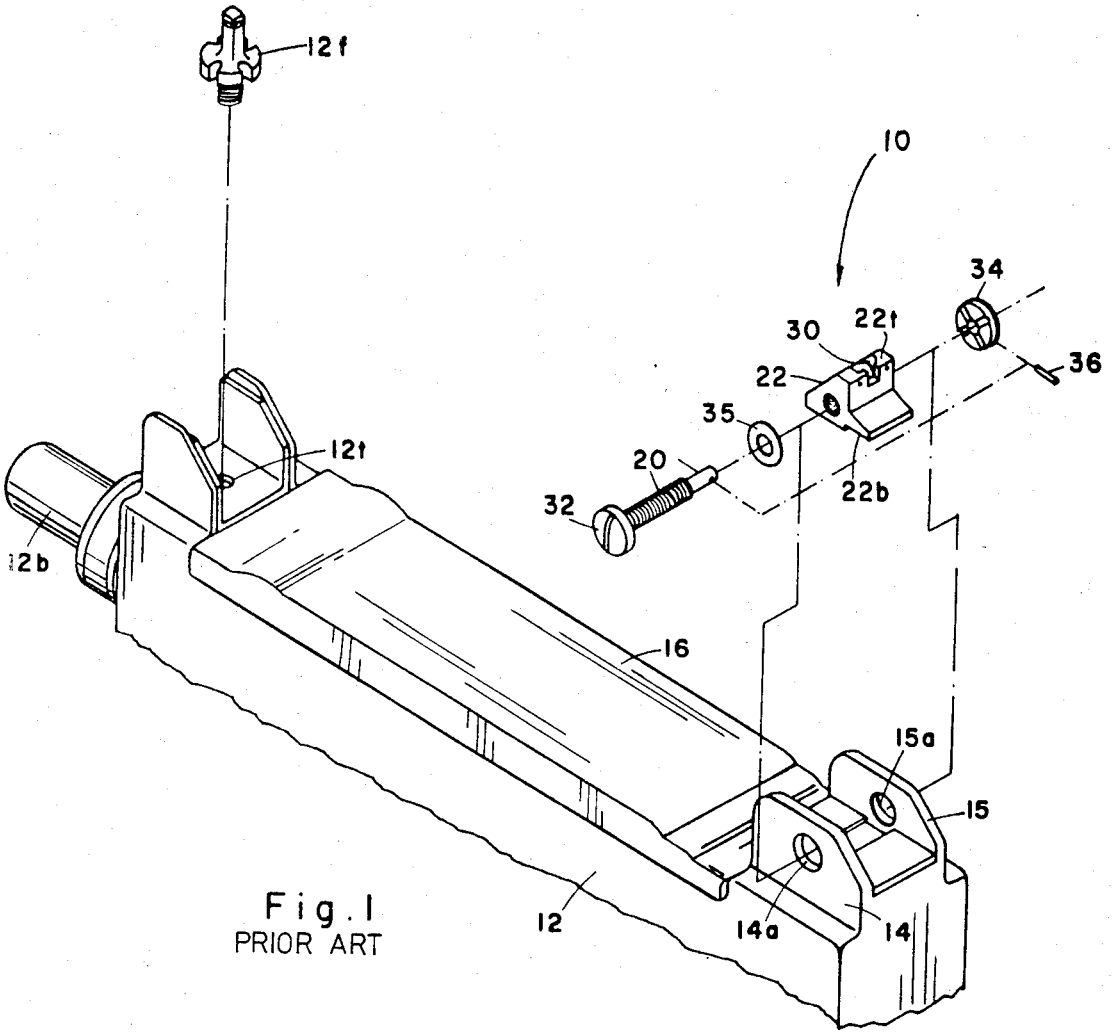
Fig. 1 PRIOR ART
FIG. 1 is an exploded, perspective view of a prior art rear sight assembly.
Figure 2:
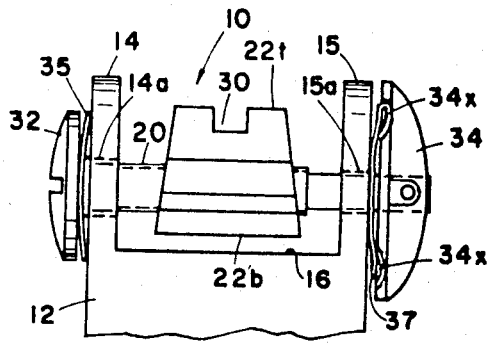
Fig. 2 PRIOR ART
FIG. 2 is a rear elevational view of the prior art sight assembly of FIG. 1 in assembled form.

DETAILED DESCRIPTION OF THE PREFERRED EMBODIMENTS;

In order to highlight the novelty and significant advantages of the present invention an advanced prior art rear sight will be described in connection with FIGS. 1 and 2. FIG. 1 is an expanded isometric view primarily of the top of a gun 12, its barrel 12*b*, its front sight 12*f* and its rear sight 10, while FIG. 2 is a side back view of the gun and the rear sight 10. Briefly, the prior art rear sight 10 for gun 12, e.g. a submachine gun, is supported by a pair of spaced apart ears 14 and 15 which extend from the gun's top side 16 at its opposite sides. The rear sight 10 may be thought of as consisting of a lead screw 20 which extends through clearance openings 14*a* and 15*a* in the two ears. Travelling on the threaded lead screw 20 is a sight block 22 which threadably engages the threads of the screw. The sight block has a bottom side 22*b* which just clears the gun's top side 16 while its top side 22*t* has a U-shaped slot 30. It is this slot which serves as the sight with which the front sight 12*f* is being aligned. The latter is threadably engageable in a threaded hole 12*t* for range adjustment.

A head 32 beyond ear 14 terminates one end of the screw 20, while a locking washer 34 is locked to and terminates the other end of the screw beyond ear 15 by means of locking pin 36. A spring washer 35 biases the head 32 away from ear 14 thus urging washer 34 toward ear 15.

Preferably, the locking washer 34 is provided with indentations or slots 34*x* while a clip element 37, which is fixedly attached to ear 15 has perturbations extending therefrom. These perturbations when extending into slots 34*x* produce relatively secure locked positions for the screw 20.

The sliding of the sight block 22 to the right or left, so as to slide the sight groove 30 toward one side of the gun or the other, for alignment purposes, is achieved by turning the leadscrew 20 by means of its head 32 in one direction or the other. As the screw 20 is rotated, once bottom side 22*b* of block 22 abuts the gun's top 16, the rotary motion of the screw results in linear motion of the block along the screw. It should again be pointed out that to "lock" the sight the perturbations of element 37 must extend into the slots or indentations 34*x* of lock washer 34. The greater the number of the perturbation-indentation pairs and/or the number of threads of screw 20 per unit length, the finer the adjustment of the sight 10.

Figure 3:
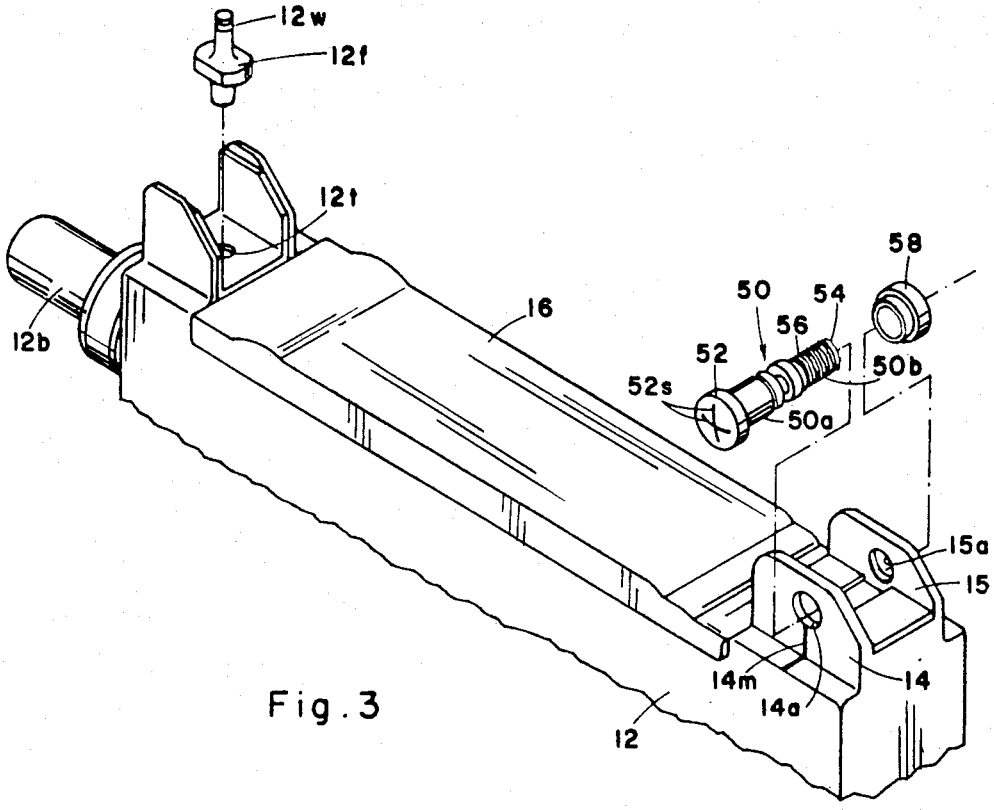
FIG. 3 is an exploded, perspective view of one embodiment of a rear sight assembly according to the present invention.
Figure 4:
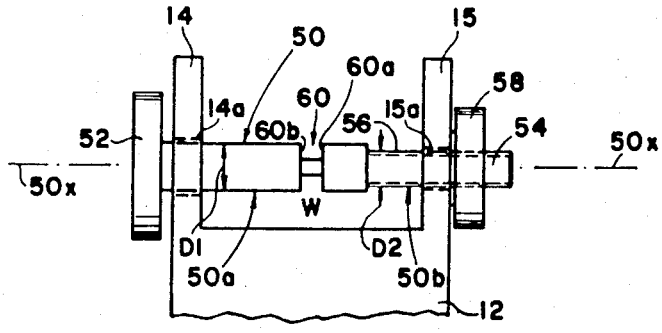
FIG. 4 is a rear elevational view of the sight assembly of FIG. 3, in assembled form.
Figure 5:
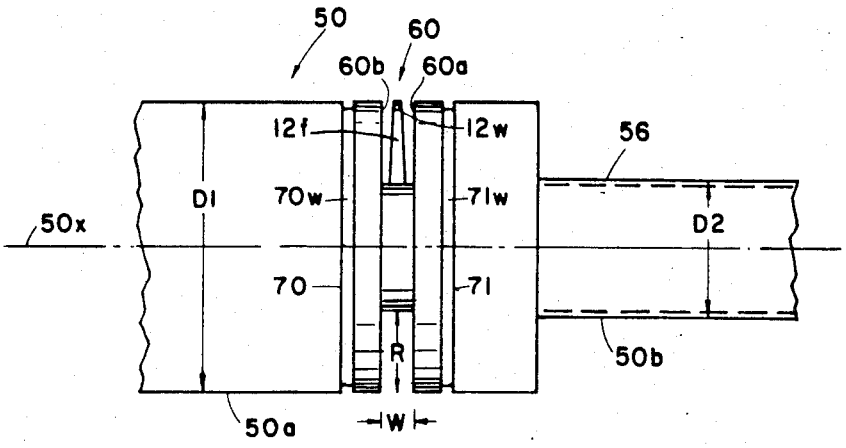
FIG. 5 is a rear elevational view of another embodiment of a rear sight assembly according to the present invention.

Although the prior art rear sight functions reasonably satisfactorily, its production cost is high due to the large number of parts of which it consists, which need be machined and aligned very precisely. It is these disadvantages that are eliminated by the present invention, which will be described in connection with FIGS. 3–5. FIGS. 3 and 4 are similar to FIGS. 1 and 2 in connection with which the prior art was described. FIG. 5 is an enlarged view of part of the sight. Therein elements like those previously described are designated by like numerals.

The novel rear sight unit essentially consists at most of two parts. They are a bolt-like element 50, hereafter simply referred to as bolt 50, which has a head 52 at one end. The bolt may be thought of as consisting of two parts or portions which successively extend from head 52 to the bolt's opposite end 54. The first portion which extends from the head toward end 54 is designated by 50*a* and the second portion 50*b* extends from portion 50*a* to end 54.

Portion 50*a* is cylindrically shaped and its outer periphery is not threaded. Its diameter is designated by D1 (see FIGS. 4 and 5). Bolt portion 50*b* is of reduced diameter D2, i.e. D1>D2 and is threaded as designated by 56.

The total length of bolt 50 i.e. portions 50*a* and 50*b* is greater than the distance between the outer faces of the ears 14 and 15. The diameter of opening 14*a* in ear 14 is slightly greater than D1, to provide some clearance for the bolt 50 to extend therethrough. As to opening 15*a* in ear 15, it is a threaded opening whose threads engage threads 56 on the bolt portion 50*b*. The distance between the ears' outer faces is less than the total length of the bolt 50 so that the end of the latter's threaded portion 50*b* can be threaded through opening 15*a* in ear 15 as shown in FIGS. 4 and 5, and extend therethrough, while the head 52 clears ear 14.

A nut 58 is used to lock the bolt 50 in any selected fixed position. As shown in these figures a radial groove or recess 60 is formed in the non-threaded cylindrical portion 50*a*. It is this recess which acts as the rear sight. The recess, when viewed above (or below) the bolt longitudinal 50*x* is shown U-shaped. Clearly its depth, designated R, is less than the bolt's radius, i.e. it is less than (D1)/2, otherwise the bolt would be cut through. As to the recess width, designated by W, it is chosen to be wide enough to form an adequate sight so that the front sight 12*f* could be aligned between its side walls 60*a* and 60*b*. (See FIG. 5). More particularly, the top or tip of the front sight is aligned with the top of the recess 60, as shown in FIG. 5, which as stated is an enlarged, side view of a section of the bolt which includes the recess 60.

Figure 6:
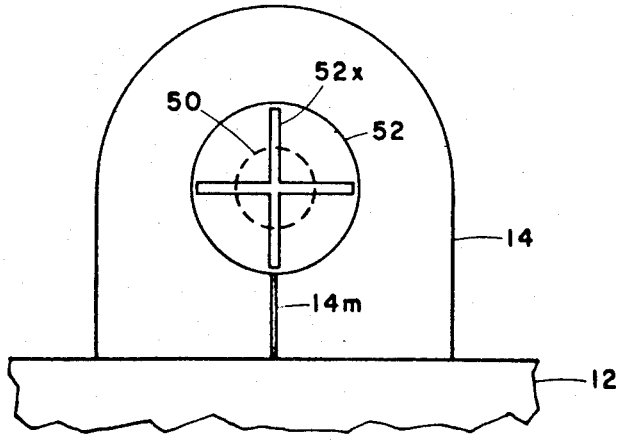
FIG. 6 is a left-side elevational view of the sight assembly of FIG. 4.

It should be apparent that since the sight-forming recess 60 is radially directed, at any rotation position of bolt 50, a U-shaped sight 60 appears above the bolt's axis 50*x*. This sight can be adjusted laterally merely by loosening nut 58 and rotating the bolt, by turning its head 52, so as to cause lateral bolt and thus sight movement and then locking it, by locking the bolt by means of nut 58. Thus it should be clear that the novel sight of the invention is an easily adjustable rear sight consisting of at least one part which is the unique bolt with the sight forming recess. Preferably however it also includes the locking nut 58 in order to secure the bolt in any chosen rotational position. The degree of rotation of the bolt and thus the lateral movement of the sight 60, may be indicated by providing one or more slots 52*x* in head 52 as shown in FIGS. 3 and 6, preferably painted with a bright color, e.g. white and a corresponding marking 14*m* on the ear 14.

Quite often to help the gun user to align the sight in the dark, white spots are provided near the top of the front sight, designated in FIGS. 3 and 5 by 12*w*, as well as on either side of the rear sight 60 just below its top. If desired in the novel rear sight of the invention, since at any rotational position of the bolt a different radial portion of the recess 60 forms the rear sight, two narrow radial grooves 70 and 71 of a diameter slightly less than D1 may be formed in the bolt equidistant from the recess 60. These narrow grooves may be filled with white paint or the like. Thus, at any bolt position two narrow white lines 70*w* and 71*w* would appear in a straight line with 12*w* on the front sight 12*f* just below the tops of the two sights which are to be aligned.

It should be apparent that based on the foregoing description of the novel rear sight 50, changes may be made in the described embodiment without departing from the scope of the invention. For example, if desired portion 50*b* of bolt 50 may be of the same diameter as that of section 50*a*. That is, in general D2≦D1. D2 should not be greater than D1. Otherwise the bolt would not be able to pass through opening 14*a* in ear 14, unless the opening 14*a* were made much larger than D1. However, the opening 14*a* should be only slightly greater than D1 just enough to clear the entrance of the bolt, yet secure portion 50*a* therein. Also, if desired portion 50*a*, herebefore described as having an unthreaded peripheral surface, may be threaded.

Figure 7:
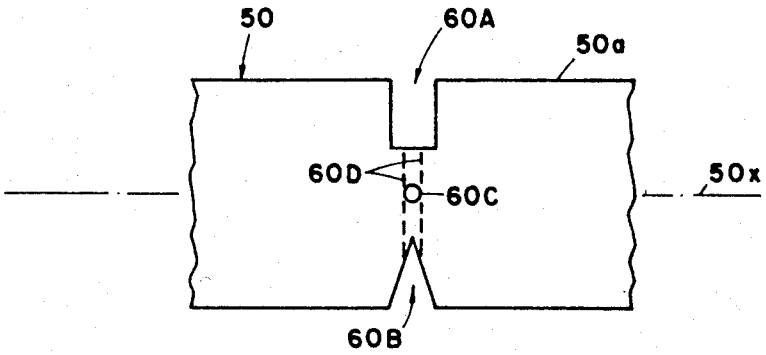
FIG. 7 is a rear elevational view of a portion of a bolt-like member forming a part of the rear sight assembly of the present invention, having one or more differently shaped sight-forming recesses.

As to the rear sight forming recess 60 it may assume other shapes than the inwardly directed recess about the entire bolt periphery. For example, one or more slots of selected shapes may be formed in a direction perpendicular to axis 50*x* to provide individual sight forming recesses, as shown in FIG. 7. Therein a rear sight formed by 60A designates an inwardly directed slot from the bolt's periphery which is U-shaped, while 60B designates an opposite rear sight which is V-shaped. Also 60C designates a through hole extending perpendicular to axis 50*x*. It can serve as a pin hole sight for initial sighting. If desired another hole, transverse to hole 60C, and designated by dashed lines 60D may be formed. It is clear that a 180° rotation of bolt 50 is required to switch between sights 60A and 60B. If desired more inward slots, perpendicular to axis 50*x* oriented less than 180° apart, may be formed. Thus, broadly defined as used herein and in the appended claims, the expression "a radial recess of preselected shape" is intended to include any recess perpendicular to the bolt axis 50*x* through which one can see from one side of the bolt to the other.

Although particular embodiments of the invention have been described and illustrated herein, it is recognized that modifications and variations may readily occur to those skilled in the art. For example the rear sight may include one or more of the recesses shown in FIG. 7. Also, although the rear sight can include only the bolt 50 without the nut 58, but preferably with it, one may form the sight with more parts without departing from the spirit of the invention. Consequently, it is intended that the claims be interpreted to cover such modifications and equivalents.

I claim:

1. For use in a gun or the like having a front sight extending upwardly from a top side of the gun near the front thereof, a rear sight alignable with the front sight and supportable by first and second spaced apart ears extending upwardly from the gun near the rear end thereof, said rear sight comprising:

an elongated bolt-like element having a head and a substantially cylindrical body extending from said head, the ears of the gun having openings through which said substantially cylindrical body is insertable and alignable to be substantially parallel with the top side of the gun, The length of said substantially cylindrical body from said head to an opposite end thereof being greater than the distance between the outer sides of the ears, whereby the opposite end of said substantially cylindrical body extends through and out from a second one of the ears, and a portion of said substantially cylindrical body adjacent said head extends through and out from a first one of the ears when said cylindrical body is inserted into the openings of the ears.

said substantially cylindrical body having a first unthreaded portion extending a specific distance from said head and having a specific diameter, which is smaller than a diameter of said first one of the ears, whereby said substantially cylindrical body is insertable therethrough to extend to said second one of the ears, and a second threaded cylindrical portion extending from said first cylindrical portion to the end of said cylindrical body, with the opening of the second one of the ears being threaded to receive said second cylindrical portion therethrough, a radial recess formed in said first cylindrical portion at a predetermined distance from said head and having a predeterminded shape, and a locking nut adapted to threadably engage the part of said second cylindrical portion extending beyond the second ear.

2. The sight of claim 1, wherein the diameter of said first cylindrical portion is equal to or greater than the diameter of said second cylindrical portion.

3. The sight of claim 1, wherein said recess is formed substantially in the shape of a cone.

4. The sight of claim 1, wherein said recess is formed substantially in the shape of a U having a depth less than one-half of the diameter of said first cylindrical portion, and a predetermined width sufficient for alignment of the front sight within said recess.

5. The sight of claim 1, additionally comprising a pair of shallow grooves on said first cylindrical portion, each groove being disposed on a respective side of said recess and being substantially equidistant therefrom, for accommodating bright coloring therewithin.

6. For use in a gun or the like having a front sight extending upwardly from a top side of the gun near the front thereof, a rear sight alignable with the front sight and comprising an elongated bolt-like element having a head and a cylindrical body extending from said head and supportable by first and second spaced apart ears having openings for receiving said cylindrical body, the opening of the second ear being threaded, said cylindrical body comprising a first unthreaded portion extending a discrete distance from said head and having a radial recess of predetermined shape therewithin at a discrete distance from said head, the improvement wherein said cylindrical body comprises a second threaded portion having a discrete diameter for engaging the threaded opening of the second ear and extending therefrom, and a locking nut provided for engaging the part of said second cylindrical portion extending beyond the second ear, whereby said bolt-like element is locked to the ears.

* * * * *